US010264829B2

(12) United States Patent
Forko

(10) Patent No.: US 10,264,829 B2
(45) Date of Patent: Apr. 23, 2019

(54) WET SPORTSWEAR TAKEOFF HELPING MEANS

(71) Applicant: Michel Forko, Zagreb (HR)

(72) Inventor: Michel Forko, Zagreb (HR)

( * ) Notice: Subject to any disclaimer, the term of this patent is extended or adjusted under 35 U.S.C. 154(b) by 0 days.

(21) Appl. No.: 15/524,040

(22) PCT Filed: Nov. 3, 2015

(86) PCT No.: PCT/HR2015/000019
§ 371 (c)(1),
(2) Date: May 3, 2017

(87) PCT Pub. No.: WO2016/075501
PCT Pub. Date: May 19, 2016

(65) Prior Publication Data

US 2017/0332709 A1 Nov. 23, 2017

(30) Foreign Application Priority Data

Nov. 11, 2014 (WO) ..... PCT/HR2014/000040
Mar. 30, 2015 (HR) ..... P 20150352 A

(51) Int. Cl.
*A41D 7/00* (2006.01)
*A41D 13/00* (2006.01)
(Continued)

(52) U.S. Cl.
CPC ..... *A41D 13/0015* (2013.01); *A41D 1/04* (2013.01); *A41D 13/012* (2013.01); *A41H 43/04* (2013.01);
(Continued)

(58) Field of Classification Search
CPC .... A41D 13/0015; A41D 13/012; A41D 1/04; A41D 2300/20
(Continued)

(56) References Cited

U.S. PATENT DOCUMENTS 560,683 A 5/1896 Brüchner
724,758 A 4/1903 Todd
(Continued)

FOREIGN PATENT DOCUMENTS

JP 2002242008 A 8/2002

OTHER PUBLICATIONS

Non Final Office Action for U.S. Appl. No. 15/524,042, dated Sep. 7, 2017, 26 pages.
(Continued)

*Primary Examiner* — Timothy K Trieu
(74) *Attorney, Agent, or Firm* — Greenberg Traurig, LLP

(57) ABSTRACT

A wet sportswear takeoff helping device for the upper sportswear that is worn extremely tight to the wearer's skin; where the takeoff helping device includes one or more guides for guiding the corresponding drawstrings and a handgrip used for activation. The guides are made on the back part of the upper sportswear, each guide begins close to the hemline and propagates to the upper part of the sportswear in a continuous way, or having one or more interruptions formed along the guide. Pulling of the handgrip by the wearer's hand causes lifting of the sportswear's hemline towards the wearer's neck to facilitate removal. The invention is applicable to an ordinary T-shirt takeoff device for helping elderly or disabled people to take off the upper garment.

14 Claims, 7 Drawing Sheets

(51) Int. Cl.
*A41D 1/04* (2006.01)
*A41D 13/012* (2006.01)
*A41H 43/04* (2006.01)

(52) U.S. Cl.
CPC ..... *A41D 2300/20* (2013.01); *A41D 2400/44* (2013.01)

(58) Field of Classification Search
USPC ..... 2/67
See application file for complete search history.

(56) References Cited

U.S. PATENT DOCUMENTS

| | | | | |
|---|---|---|---|---|
| 2,127,763 | A | 8/1938 | Bentz | |
| 5,299,323 | A | 4/1994 | Schaefer et al. | |
| 5,367,709 | A | 11/1994 | Teasley | |
| 7,412,728 | B2 * | 8/2008 | Alesina | A41D 27/28 2/69 |
| 7,841,020 | B2 | 11/2010 | Mayfield et al. | |
| 8,707,465 | B2 * | 4/2014 | Reynolds | F41C 33/048 2/102 |
| 9,089,174 | B1 * | 7/2015 | Michaelis | A41D 13/0015 |
| 2005/0197607 | A1 * | 9/2005 | Brown | A61F 5/026 602/19 |
| 2006/0143779 | A1 | 7/2006 | Lee | |
| 2009/0019622 | A1 | 1/2009 | Mayfield et al. | |
| 2010/0281597 | A1 | 11/2010 | Lang | |
| 2011/0277212 | A1 * | 11/2011 | Jones | A41D 13/0005 2/102 |
| 2016/0165971 | A1 | 6/2016 | Smith et al. | |

OTHER PUBLICATIONS

International Search Report issued in PCT/HR2015/000019 dated Jan. 18, 2016, 3 pages.
Written Opinion of the International Searching Authority issued in PCT/HR2015/000019 dated Jan. 18, 2016, 5 pages.

* cited by examiner

WET SPORTSWEAR TAKEOFF HELPING MEANS

CROSS REFERENCE TO RELATED APPLICATIONS

This application is the U.S. National Phase Application of PCT/HR2015/000019, filed Nov. 3, 2015, which claims priority to PCT Application PCT/HR2014/000040, filed Nov. 11, 2014 and Croatian Patent Application P20150352A, filed Mar. 30, 2015, the contents of such applications being incorporated by reference herein.

TECHNICAL FIELD

The present invention discloses a sportswear takeoff helping means that helps in taking off wet sportswear from the wearer, especially the upper part of the sportswear. The helping means belongs to a technical field dealing with details of garments that have an additional specific technical function.

TECHNICAL PROBLEM

Nowadays healthy life trends include more and more people in various indoor and outdoor sport activities for which a special garment is designed and worn. A part of the mentioned activities is carried out in the sportswear designed to be extremely skintight for the wearer. During the activities the sportswear becomes wet from sweat as a result of the activity, environmental conditions, or both. Once being wet, it has been observed that the upper sportswear is almost impossible to be taken off over the wearer's head. The assistance of a colleague is needed, otherwise there is a high risk of the sportswear damage. This is particularly important for the garment equipped with high-performance, microfiber, polyester fabric that should move sweat away from the body onto the fabric surface, where it evaporates. However, in rainy conditions or while performing demanding exercises, the sportswear tends to become entirely wet and impossible to be taken off.

So, the primary technical problem is to construct a simple, reliable and aesthetically acceptable helping means that allows the wet sportswear, in particular the upper sportswear designed to be extremely skintight for the wearer, to be simply taken off over the wearer's head.

Elderly people have problems with taking off T-shirts or similar garments over the head due to their health conditions regarding the spinal column, joints or limbs. Also the obesity may generate similar inability. Therefore, the solution to the primary technical problem can be easily extended to the above-observed problems. According to the invention, if the wearer is capable of touching the neck, than it is possible to use the takeoff helping means according to the invention.

PREVIOUS STATE OF THE ART

The technical problem which is solved with the present invention is the construction of a novel takeoff helping means that helps in taking off the wet skintight sportswear over the wearer's head. There are well known solutions in the art which comprise zippers or mechanic/magnetic snaps that allow the sportswear to be unzipped or unfastened along one or more hems which facilitate the takeoff procedure. However, such zippers or snaps are also cumbersome to handle by one person, not to mention that such solutions locally change the user's experience in wearing the skintight sportswear.

Probably one of the earliest technical solutions, where a part of the garment is lifted, is mentioned in the U.S. Pat. No. 560,683; inventor E. Brückner, which is incorporated by reference. The document teaches about trousers for bicyclist capable to be drawn up to the knees and retained in this shortened condition. The implemented system is composed of drawstrings and appropriate guides with a lock system.

Document U.S. Pat. No. 724,758; inventor H. M. Todd, which is incorporated by reference, teaches about a skirt or train lifter. The object of the invention is to provide a device adapted to raise and drop the back and side breadths of women's skirts without the necessity of using hands on the said breadths. The invention consist primarily of a wire frame that is attached to the back of the skirt, provided with the suitable loops through which suitable tapes or cords pass adapted to be tied together or otherwise secured at the waist of the wearer.

Document U.S. Pat. No. 2,127,763; inventor G. B. Bentz, which is incorporated by reference, teaches about improvements in overcoats, topcoats, raincoats, capes and the like. The primary focus of the said invention is to prevent the garment to be dragged down on the floor or to be stepped upon once left on a chair or similar. The contraction of the garment is achieved by the means of cords, tapes, small chains or similar means, that can be fixed to different positions within the garment, thus effectively producing a lifting hemline.

Document U.S. Pat. No. 5,299,323; inventor A. Schaefer et al., which is incorporated by reference, discloses an adjustment system for forming a repeatedly adjustable hem on a garment. The document provides an adjustment mechanism comprised of a cord with one end that is attached to the garment inside the hem, while the other end passes through a holding pocket or channel that is secured to the garment inside seam. The advantage of the cited invention is in enabling the garment to be conformed to the person without any tailoring skills.

Document U.S. Pat. No. 5,367,709; inventor N. A. Teasley, which is incorporated by reference, discloses adjustable clothing for infants and toddlers that reversibly adjusts in length what accommodates the growth of a child. Adjusting is performed via drawstrings situated in the side seams, and fixing in a desired position is provided via knots formed by the drawstrings.

Document US 2010/0281597; inventor J. A. Lang, which is incorporated by reference, discloses a partial garment lift/quick-access system for installation in the upper body garment for wearers who have a need for immediate and unobstructed access to the waist/belt line to retrieve essential items. The quick-access system allows the wearer to immediately expose an item at the waist/belt line, for a complete and unobstructed access by pulling a simple cord at the chest pocket. This action produces a curtain-like effect at the bottom hem of the garment; assisting the wearer to make a rapid hand-to-item contact while keeping the hem of the garment suspended for the duration of the required activity.

Document US 2006/0143779; inventor C. Lee, which is incorporated by reference, discloses an article of clothing with two panels, front and back, that are easily detachable one from another, and which may serve also as a takeoff helping means.

Document US 2011/277212; inventor C. G. Jones, which is incorporated by reference, discloses a vest that the user can remove without removing an outer garment such as a coat. The vest utilizes the hook and loop fasteners to allow the back and front to be separated. In order to facilitate the separation, a pull cord is attached at the rear shoulder and crosses the back of the vest and passes through a guide near the opposing hip. When the pull cord is pulled the opposing shoulder that has been separated is peeled back and down across the back allowing the user to remove the vest without removing an overcoat.

Document JP 2002242008; inventor F. Kawaguchi, which is incorporated by reference, discloses a bodysuit which has a concise structure and that is easily taken off. The bodysuit comprises an upper trunk with arm parts and a neck part with an opening, and a lower trunk with leg parts wherein at least one tensile operation member is used for transforming the opening of the neck part in order to be easily taken off.

SUMMARY OF THE INVENTION

From the above-cited documents it is easy to conclude that none of the cited documents solve the takeoff problem observed with the skintight sportswear. The drawstrings or cords are used exclusively to lift trousers, skirts, or similar garments and to adjust or modify the garments appearance and functionality; not to perform the takeoff action for the skintight and wet sportswear; or even regular T-shirts used by elderly or disabled people.

The above technical problems are solved with a device basically composed from one or more guides equipped with the corresponding, i.e. compatible, drawstrings attached to the hemline situated in the back of the garment that ends with the handgrip. The guides are situated preferably on the back part of the upper garment; where the guides start near the hemline and go to the garment top in a continuous way or in one or more continuous segments.

An aspect of the present invention solves the technical problem by lifting a hemline situated on the sportswear back. That is rather different from the below cited well-known solutions. It is instructive to examine the previous state of the art in the segment; i.e. to search for the garment that is equipped with the means for lifting or taking off a garment, or at least a part of it.

An aspect of the present invention discloses a wet sportswear takeoff helping means for the upper sportswear that is worn extremely tight to the wearer's skin and is wet from sweat, as a product of exercise, environmental conditions, or both. The takeoff helping means consists of one or more guides for guiding the drawstrings and the handgrip used to activate the takeoff helping means.

The guides are made on the back part of the said upper sportswear and are situated on the inner sportswear surface oriented to the wearer's skin, outer sportswear surface or on both sportswear surfaces simultaneously. Each guide has a guide beginning situated close to the hemline from which the guide propagates to the upper part of the sportswear in a continuous way, or having one or more interruptions formed along the said guide.

Each drawstring is connected with the hemline in the joint region. The drawstring enters into the corresponding guide beginning, and passes through the corresponding guide till the guide end, or till the connection of the two or more guides. The drawstring end fixed to the handgrip or fixed to another drawstring within the connection of the two or more guides. Pulling of the handgrip by the wearer's hand causes lifting of the sportwear hemline towards the wearer's neck.

In one variant each guide is formed from a material which is partially fixed to one of the sportswear sides allowing an unobstructed movement of the corresponding drawstring within. The material used for the guides is fixed to the sportswear via stitching, ultrasound or laser welding, by gluing the material to the sportswear; or any other way that is known in the art. In one sub-variant, the material for the guides is selected to be textile material.

In another variant, the guides are formed via stitches that enclose the drawstrings situated on the back part of the said sportswear. The stitches were fixed to the sportswear in a way allowing an unobstructed movement of the drawstrings situated between the stitches and the sportswear. In one sub-variant, the guides are formed as zigzag stitches.

The invention also discloses other variants for the drawstrings propagation. The invention is applicable as an ordinary T-shirt takeoff means helping elderly or disabled people to take off the upper garment.

BRIEF DESCRIPTION OF DRAWINGS

Some embodiments were described via figures representing the invention variants. The figures represent the embodiments where the guides are formed on the inner side of the sportswear; the guides being formed as dense zigzag stitching where the drawstrings are inserted into the guides.

DETAILED DESCRIPTION

Figure 1A:
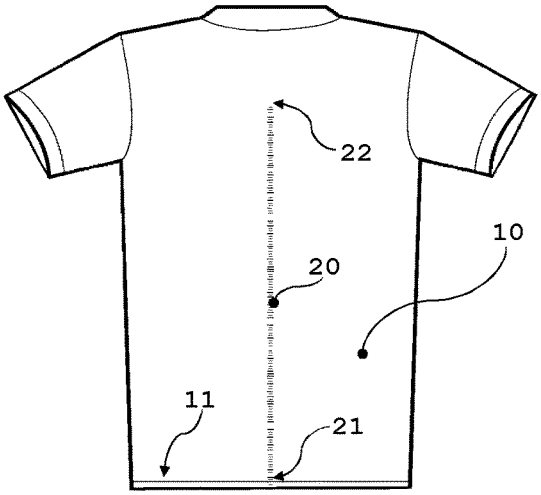
FIG. 1A shows the technical solution with only one drawstring situated centrally on the inner side of the sportswear.

The present invention discloses a sportswear takeoff helping means that helps in taking off the wet sportswear from the wearer, especially the upper part of the sportswear. The garment equipped with a high-performance, microfiber, polyester fabric such as Nike's DRI-FIT® is designed to remove sweat away from the body and to the fabric surface, where it evaporates. As the technical result the wearer is dry all the time and does not lose the heat that is necessary for achieving good sports results. The said class of materials is used for many different garments, not only for manufacturing upper sportswear.

However, in case of rain or heavy exercises being performed, the sportswear becomes entirely wet. In case of the upper sportswear it becomes almost impossible to take it off over the head by the wearer alone. Usually the takeoff procedure requires one person for assistance in order not to damage the skintight sportswear, e.g. during long-distance running, cycling or extreme climbing. Wet DRY-FIT® or similar garments produce significant friction between the wearer's skin and the said material, and a forced takeff will result in the garment damage.

The present invention helps to solve the above-observed technical problems via embodiments described hereby in detail. It discloses a simple, reliable and aestheticly acceptable takeoff helping means for the upper sportswear that is worn extremely tight to the wearer's skin, and which is wet from sweat as a product of exercise, environmental conditions, or both.

The wet sportswear takeoff helping means for the upper sportswear (10) that is worn extremely tight to the wearer's skin (90) consists of one or more guides (20) for guiding the drawstrings (30) and handgrip (80) used for activation of the said takeoff helping means.

One or more guides (20) are made on the back part of the said upper sportswear (10) and are situated on the inner sportswear (10) surface oriented to the wearer's skin (90), the outer sportswear (10) surface or on both sportswear (10) surfaces simultaneously. Each guide (20) propagates to the upper part of the sportswear (10) in a continuous way, or having one or more interruptions (24) formed along the said guide (20) as we will discuss in the examples.

Figure 1B:
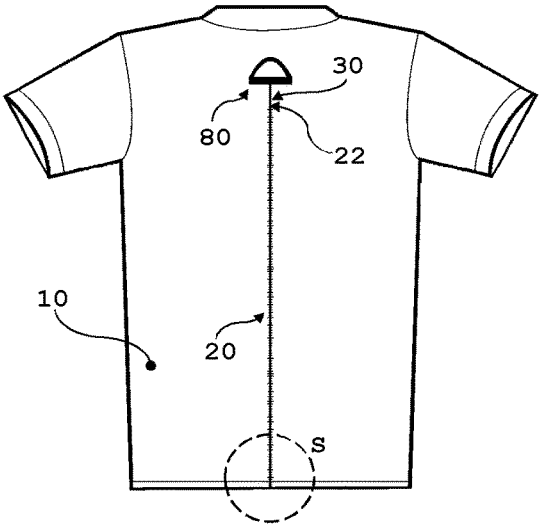
FIG. 1B shows the inside construction of the sportswear when the inner side is turned to be the outer side in order to better depict the technical solution.
Figure 1C:
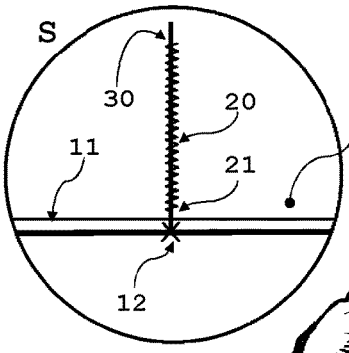
FIG. 1C shows the way of connecting the drawstring with the hemline.

The drawstrings (30) used for activation are connected to the hemline (11) in the joint region (12) as depicted in FIG. 1C. The drawstring (30) can be connected to the hemline (11) by any known method in the art such as: gluing, ultrasound or laser welding. However, the most practical way is to sew the drawstring (30) directly into the hemline (11).

In the present invention, each drawstring (30) enters into the corresponding guide beginning (21) and passes through the corresponding guide (20) till the guide end (22), or till the connection (23) where this, and possibly other guides (20), are connected together.

The drawstring material can be selected from the set of suitable materials known in the art, having appropriate tensile strength. As a good example one can use even shoelaces. Each drawstring (30) end fixed to the handgrip (80) or fixed to another drawstring (30) within the connection (23) to other drawstrings (30) where two or more guides (20) are merged together.

Figure 1D:
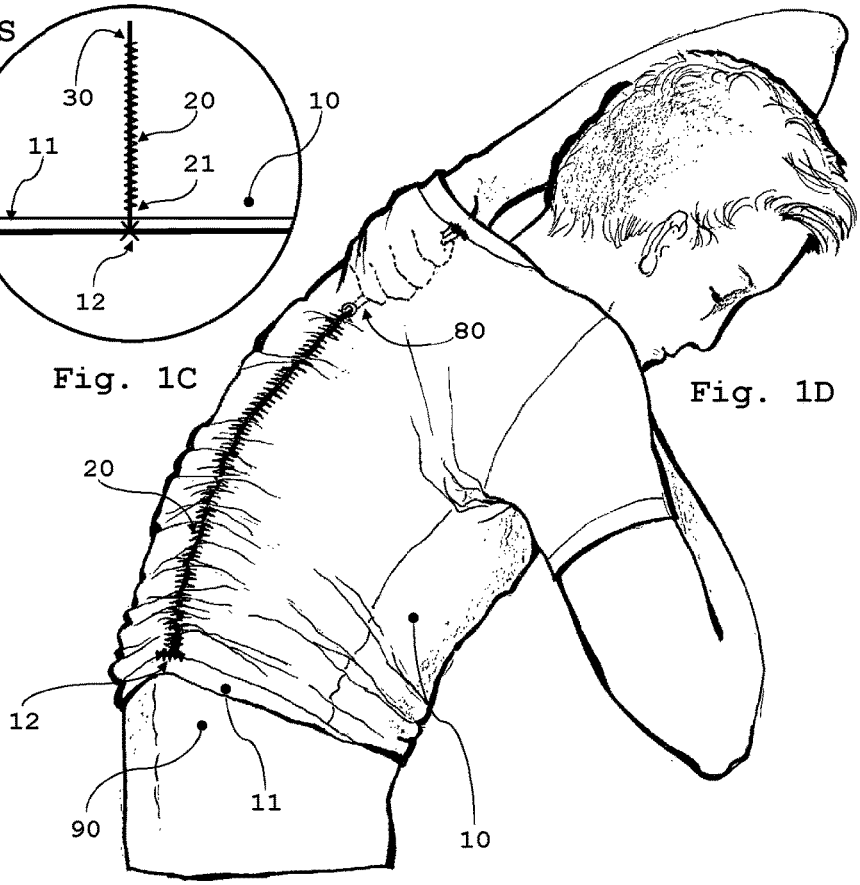
FIG. 1D shows the activation of the embodiment.
Figure 2A:
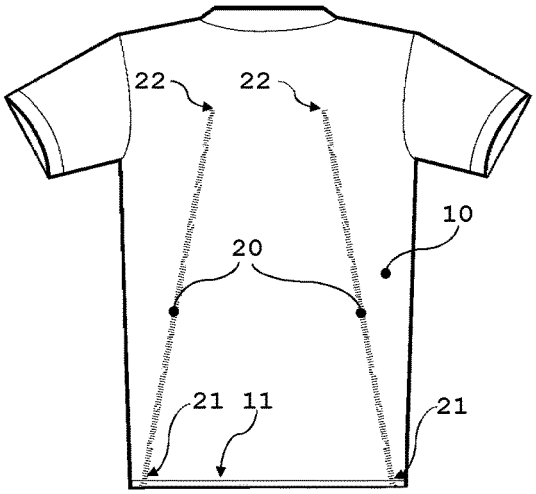
FIG. 2A shows the technical solution with two drawstrings situated on the inner side of the sportswear.
Figure 2B:
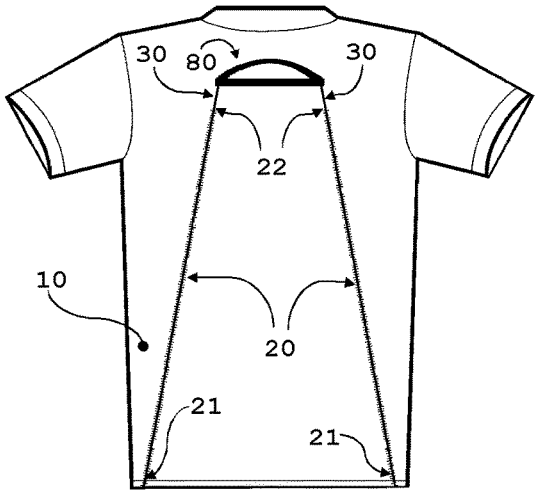
FIG. 2B shows the inside construction of the sportswear when the inner side is turned to be the outer side in order to better depict the technical solution.
Figure 2C:
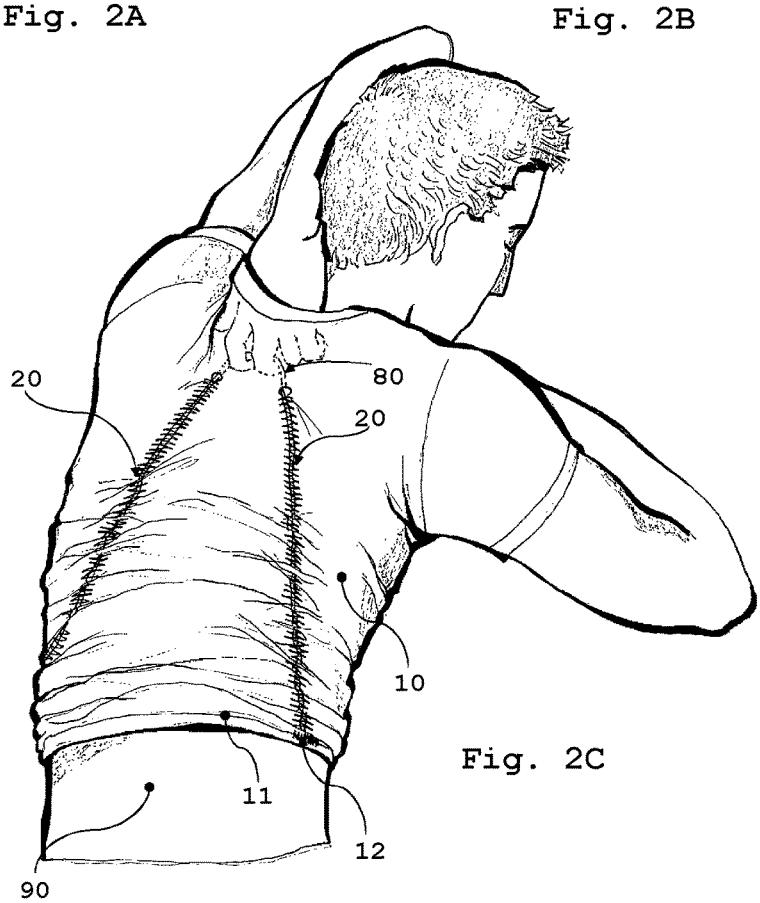
FIG. 2C shows the activation of the embodiment.
Figure 3A:
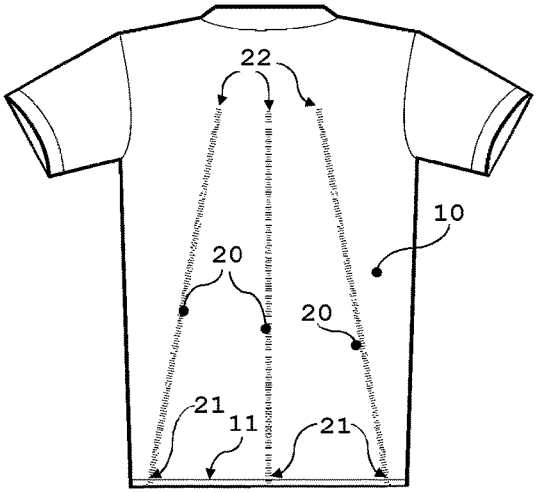
FIG. 3A shows the technical solution with three drawstrings situated on the inner side of the sportswear.
Figure 3B:
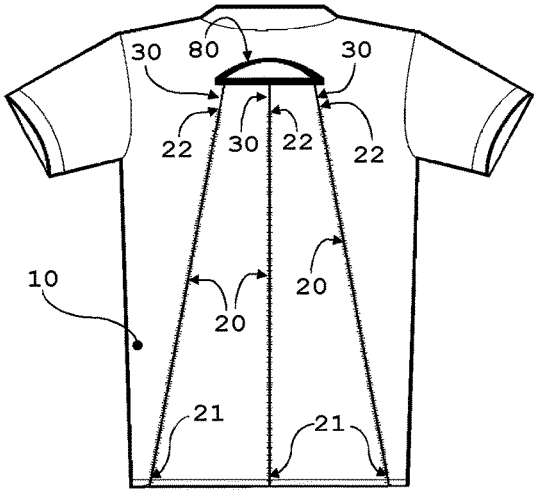
FIG. 3B shows the inside construction of the sportswear when the inner side is turned to be the outer side in order to better depict the technical solution.
Figure 3C:
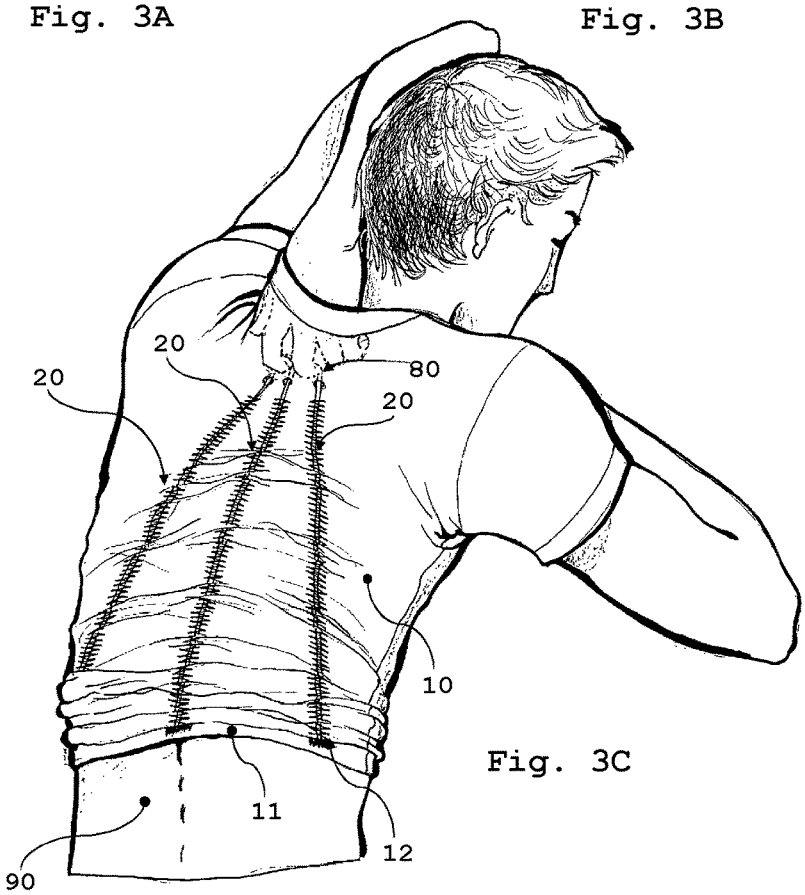
FIG. 3C shows the activation of the embodiment.

FIGS. 1D, 2C, 3C, . . . 7C depict the activation of the sportswear (10) takeoff means by pulling off the handgrip (80) by the wearer's hand which causes lifting of the sportswear hemline (11) towards the wearer's neck. It is important to note that the handgrip (80) is situated close to the sportswear (10) top, i.e. within the wearer's neck region. The handgrip (80) can be manufactured from any suitable material known in the art capable of being connected with the used drawstrings (30) and comfortable enough for the wearer, preferably from textile materials, thermoplastic resins or elastomer materials.

The guides (20) can be manufactured from any convenient material known in the related art. The material used has to be appropriately fixed to the back side of the sportswear (10), to ensure an unobstructed movement of the corresponding drawstring (30) within the guides (20). Furthermore, the material used for the guides (20) is fixed to the back side of the sportswear (10) by any suitable manner known in the art; by sewing/stitching, ultrasound or laser welding or gluing, where the material together with the material used for the sportswear back forms sleeves that serve as the drawstring (30) guides (20). Preferred material for the guides (30) is any textile material, but the optimal material is any material that has mechanical properties similar to those used to manufacture sportswear.

In another aspect of the invention, the guides (20) can be formed solely via stitches that enclose the drawstrings (30). The stitches are fixed to the sportswear (10) in a way that allows an unobstructed movement of the drawstrings (30) situated between the stitches and the material used to form the sportswear (10). The longitudinal stitches density has to be carefully chosen as well as the stitches tension exerted to the material used for the sportswear in order to maintain an unobstructed movement of the drawstrings (30) in all cases, and to prevent slitting of the sportswear by extreme use. The zigzag stitches are found to be adequate for the above-mentioned task and can be considered as a preferred solution.

Examples—General Remarks

The following examples, which we will study in more details, use the guides (20) formed as the zigzag stitches which are situated in a way to enclose the drawstrings (30) positioned on the inner side of the sportswear, i.e. oriented towards the wearer's skin (90). These examples do not limit the scope of protection given by the claims and are used solely to demonstrate the simplest possible variants of the present invention.

A person skilled in the art will, without any difficulties or further assumptions, extend the disclosed teaching to more complex cases.

Example 1—Uninterrupted Guide

FIGS. 1A-1D depict the construction and use of the takeoff means that consists of only one guide (20) and a drawstring (30). The other side of the sportswear (10), as visible from FIG. 1A, the guide (20) propagates from the guide beginning (21) till the guide end (22) situated close to the neck position of the said sportswear (10), within the region where the wearer can reach it by hand via wearer's shoulder, FIG. 1D.

In the above-mention case, the guide (20) is formed around the drawstring (30) on the back side of the sportswear (10). FIG. 1B shows the sportswear (10) and its appearance when the inner side is turned out. In this specific case, the drawstring (30) is positioned on the inner sportswear (10) side that is previously turned out and then zigzag stitches enclose the drawstring (30) forming the guide (20). The drawstring (10) can be stitched to the hemline (11) in the joint region (12) before or after the guide (20) is formed, as depicted in FIG. 1C. Another end of the drawstring (10) is attached to the handgrip (80) as shown in FIG. 1B.

Now, the sportswear (10) can be again turned from the state depicted in FIG. 1B where the inner side is turned out again to show the "normal" appearance of the sportswear (10) as seen in FIG. 1A where the guide (20) is situated behind the sportswear (10) material used to form the backside.

The activation of the takeoff helping means is shown in FIG. 1D; the user/wearer tucks the hand beneath the neck portion of the sportswear (10), grabs the handgrip (80) and pulls it up towards the head. This action causes lifting of the hemline (11) resembling another person assisting the wearer in case where the sportswear (10) does not have any takeoff helping means. The wearer grabs the front part of the hemline (11) with another hand so that the wearer can, despite significant friction between the skin (90) and the sportswear (10), lift the sportswear (10) and take it off without damaging it.

The handgrip (80) used in the aforementioned example can be manufactured from any suitable material while being big enough to be easily gripped. In addition, it is important for the handgrip (80) to be wider than the guide (20), more precisely, wider that the guide end (22) in order to prevent unwanted entrance of the handgrip (80) into the guide (20). A preferable solution for the handgrip (80) is to be made as a loop of textile material in order to preserve the wearer's comfort. The disadvantage of the disclosed solution is that the force exerted to the joint region (12) might be too high and can damage the sportswear (10) fabrics in the long-term use.

Example 2—Two Uninterrupted Guides

FIGS. 2A-2C show the construction and use of the takeoff means that consists of two guides (20) and two corresponding drawstrings (30). The guides (20) are formed in the way described in the example 1. The solution with two guides (20) has the advantage over the solution disclosed in the example 1 because the force exerted on each joint region (12), where the drawstrings (30) are attached to the hemline (11), is reduced to ½, thus preventing the tearing of the joint region (12). The activation is similar to the procedure already explained in the example 1.

Example 3—Three Uninterrupted Guides

FIGS. 3A-3C show the construction and use of the takeoff means that consists of three guides (20) and three corresponding drawstrings (30). The guides (20) are formed in the way described in the example 1. The solution with three guides (20) has the advantage over the solution disclosed in the example 1 because the force exerted on each joint region (12), where the drawstrings (30) are attached to the hemline (11), is reduced to ⅓, thus preventing the tearing of the joint region (12). The activation is similar to that explained in the example 1.

Example 4—Three Guides

Figure 4A:
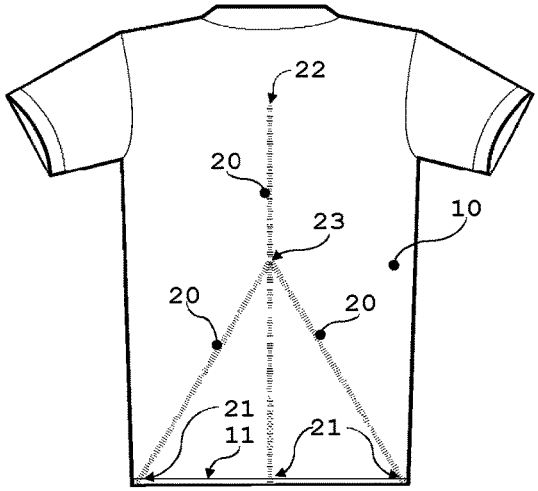
FIG. 4A shows the technical solution with three drawstrings, two being connected to the central drawstring and situated on the inner side of the sportswear.
Figure 4B:
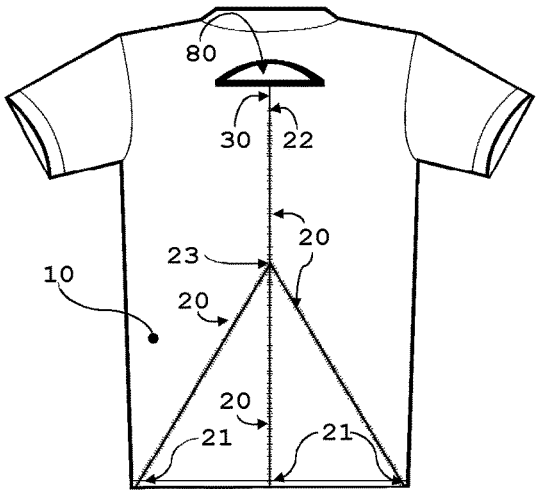
FIG. 4B shows the inside construction of the sportswear when the inner side is turned to be the outer side in order to better depict the technical solution.
Figure 4C:
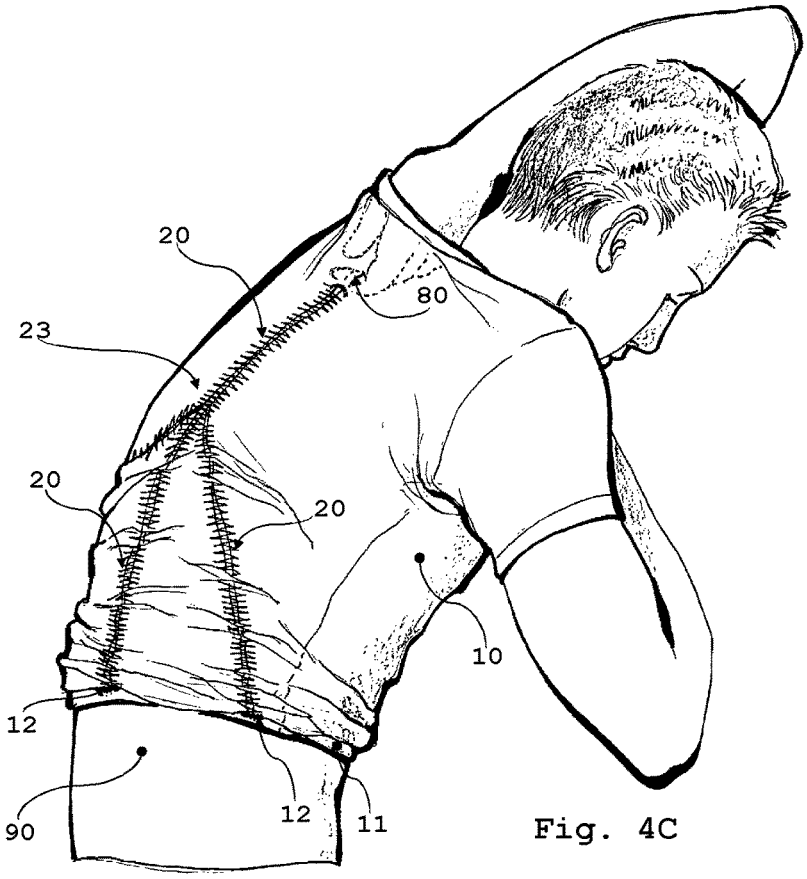
FIG. 4C shows the activation of the embodiment.

FIGS. 4A-4C show the construction and use of the takeoff means that consists of three guides (20) and three corresponding drawstrings (30). The two of the mentioned guides (20) end in the connection (23) formed on the central guide (20), at approx. ½ of its length. The central guide (20) is propagating from the hemline (11) to the neck part of the sportswear (10).

This example has two sub-variants; the first one in which all the drawstrings (30) are propagating from the joint region (12) till the handgrip (80), and the second one, where the two side drawstrings (30) ends connected to the drawstring (30) belonging to the central guide (20) in the part where the side guides (20) end in the connection (23). In the latter case, the drawstring (30) belonging to the central guide (20) propagates from the joint region (12) till the handgrip (80).

Regardless of the sub-variant, as in previous examples the system of drawstrings (30) is prepared and positioned on the outer side of the sportswear (10) as depicted in FIG. 4B. The drawstrings (30) can be immediately fixed to the hemline (11) and/or handgrip (80), or after the guides (20) are formed. Then, the guides (20) are formed around the drawstrings (30) by using zigzag stitches. If the first sub-variant is used than the zigzag stitches for the central guide (20) in the part starting from the connection (23) to the corresponding guide end (22) should be formed slightly wider. Namely, that part should guide all three drawstrings (30) towards the handgrip (80).

Once the guides (20) are formed around the drawstrings (30) connected to the hemline (11) and handgrip (80) or other drawstrings (30), the sportswear (10) is turned onto its ordinary wearing side depicted in FIG. 4A where only the stitches are visible. The activation is similar to those explained in the previous examples.

Example 5—Two Intersecting Guides

Figure 5A:
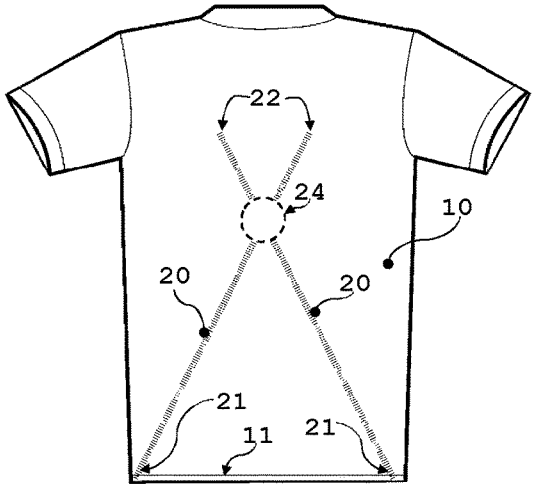
FIG. 5A shows the technical solution with two intersecting drawstrings situated on the inner side of the sportswear where each drawstring can move independently.
Figure 5B:
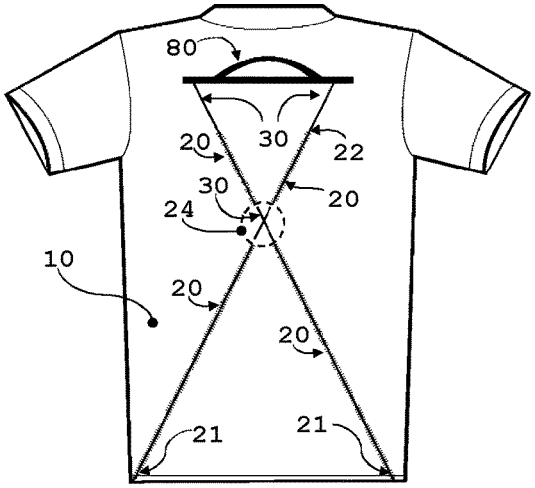
FIG. 5B shows the inside construction of the sportswear when the inner side is turned to be the outer side in order to better depict the technical solution.
Figure 5C:
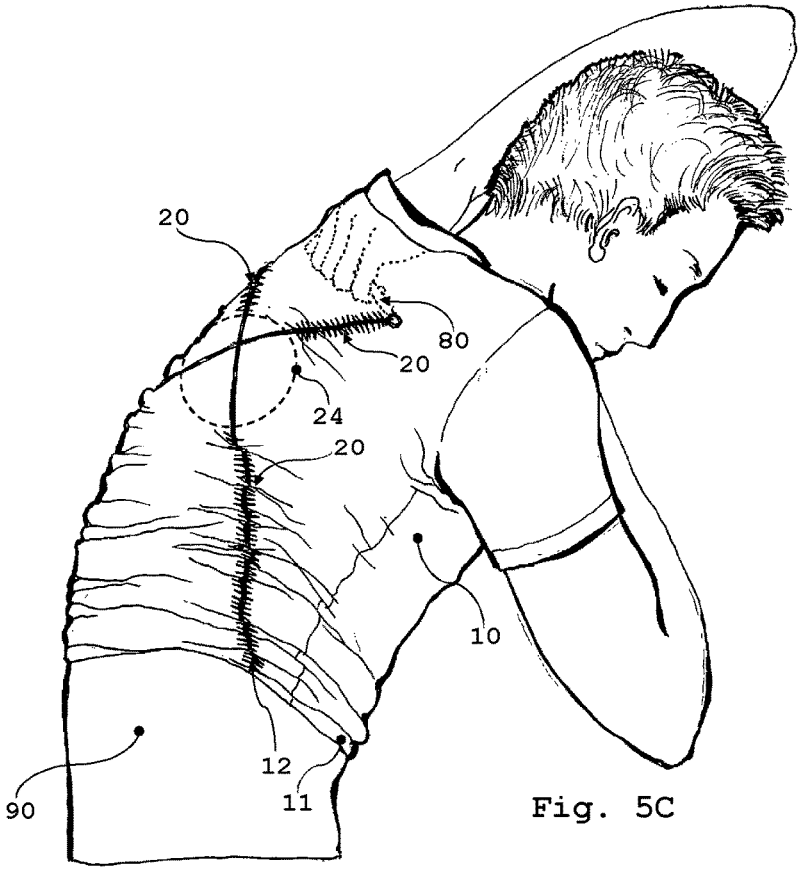
FIG. 5C shows the activation of the embodiment.

FIGS. 5A-5C show the construction and use of the takeoff means that consists of two intersecting guides (20) and two corresponding drawstrings (30) crossing each other in the guides interruption (24) region that overlapped each other.

As described in the previous examples the system of drawstrings (30) is prepared and positioned on the outer side of the sportswear (10) as depicted in FIG. 5B. The drawstrings (30) can be immediately fixed to the hemline (11) and/or handgrip (80), or after the guides (20) are formed. Then, the guides (20) are formed around the drawstrings (30) by using zigzag stitches. In this example, each guide (20) is formed in two parts; the first part starts from the guide beginning (21) to the interruption (24), and the second part from the interruption (24) region till the guide end (22). The interruption (24) is depicted in FIGS. 5A, 5B and 5C via a dashed circle. In the above-mentioned way, the drawstrings (30) cross each other across the interruption (24) without interference and so the produced technical effect is more or less similar to that described in the example 2.

Once the guides (20) are formed around the drawstrings (30) connected to the hemline (11) and handgrip (80), the sportswear (10) is turned onto its ordinary wearing side depicted in FIG. 5A where only the stitches are visible. The activation is similar to those explained in the previous examples and depicted in FIG. 5C. It has to be mentioned that by tilting the handgrip (80), if it is formed as a solid body, or by pulling mainly the left or right part of the depicted handgrip (80) it is possible to dose the pulling force exerted on the left or right drawstring (30) and transmitted to the appropriate part of the hemline (11).

Example 6—Guides as the Side Seams

Figure 6A:
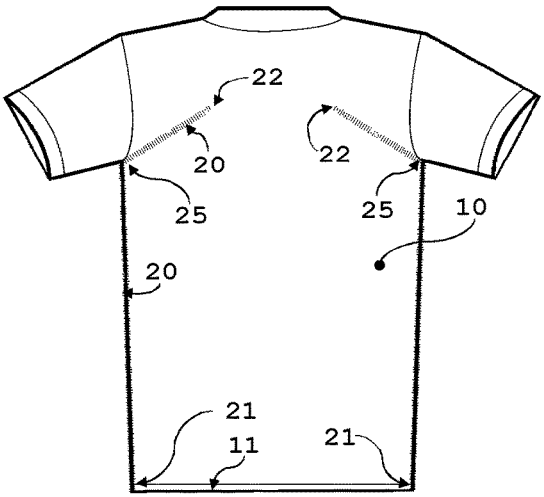
FIG. 6A shows the technical solution with two drawstrings having the side seams as the guides, situated on the inner side of the sportswear.
Figure 6B:
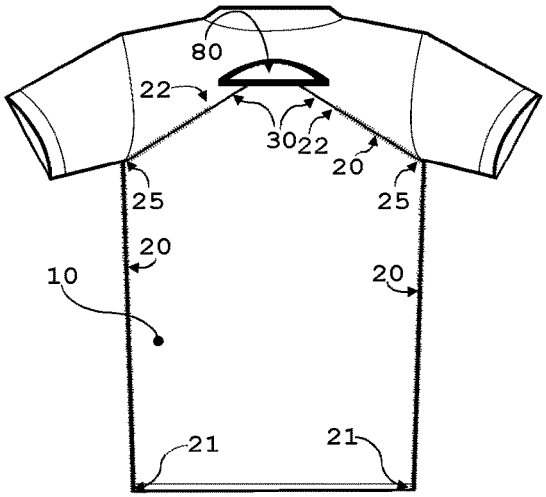
FIG. 6B shows the inside construction of the sportswear when the inner side is turned to be the outer side in order to better depict the technical solution.
Figure 6C:
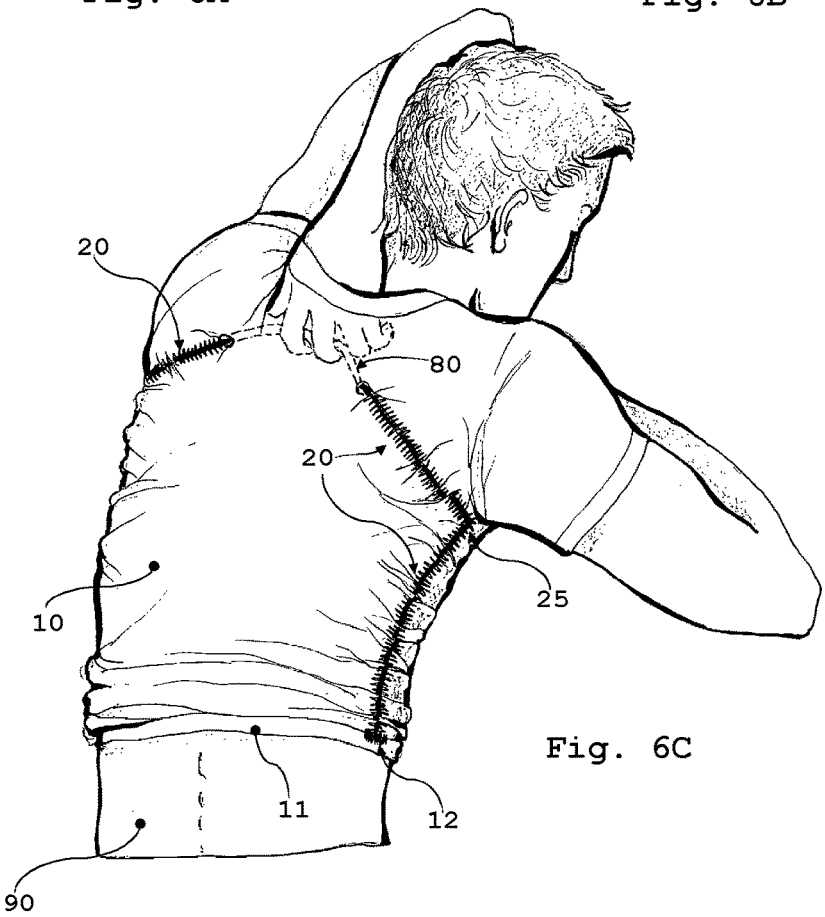
FIG. 6C shows the activation of the embodiment.

FIGS. 6A-6C show the construction and use of the takeoff means that consists of two guides (20) and two corresponding drawstrings (30) where the guides (20) are partially used side seams of the sportswear (10) connecting the front and back part of the sportswear (10).

As described in the previous examples the system of drawstrings (30) is prepared and positioned on the outer side of the sportswear (10) as depicted in FIG. 6B. The drawstrings (30) can be immediately fixed to the hemline (11) and/or handgrip (80), or after the guides (20) are formed. Then, the guides (20) are formed around the drawstrings (30) by using zigzag stitches. In this example the sportswear (10) side seams are used as the guide (20) for the drawstring (30) from the hemline (11) to the kinks (25) situated beneath the sleeves. Additional guides (20) that pass from the said kinks (25) towards the neck portion which ends with the guide ends (22) are formed in the manner already explained in the previous examples.

Once the guides (20) are formed around the drawstrings (30) connected to the hemline (11) and handgrip (80), the sportswear (10) is turned onto its ordinary wearing side depicted in FIG. 6A where only the stitches are visible. The activation is similar to those explained in the previous examples and depicted in FIG. 6C.

Example 7—Guides as the Side Seams with Additional Central Guide

Figure 7A:
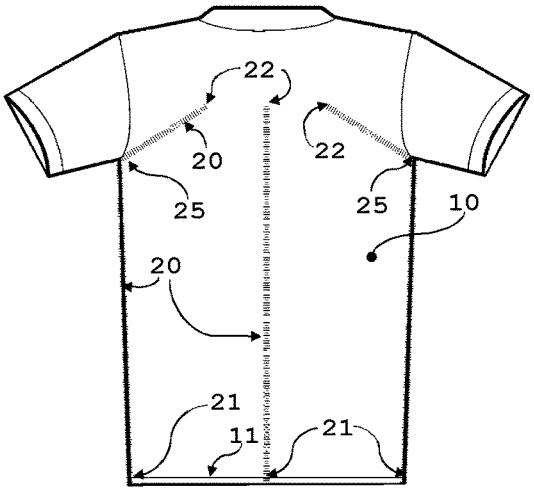
FIGS. 7A, 7B and 7C show the technical solution similar to those presented via FIGS. 6A, 6B and 6C where an extra guide and a drawstring are added in the manner already depicted via FIGS. 1A, 1B, 1C and 1D.
Figure 7B:
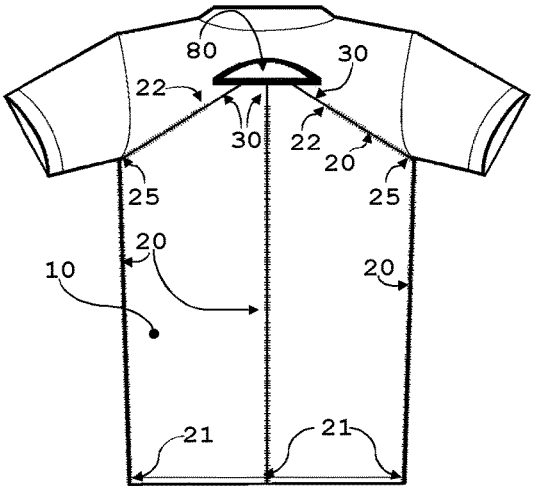
Figure 7C:
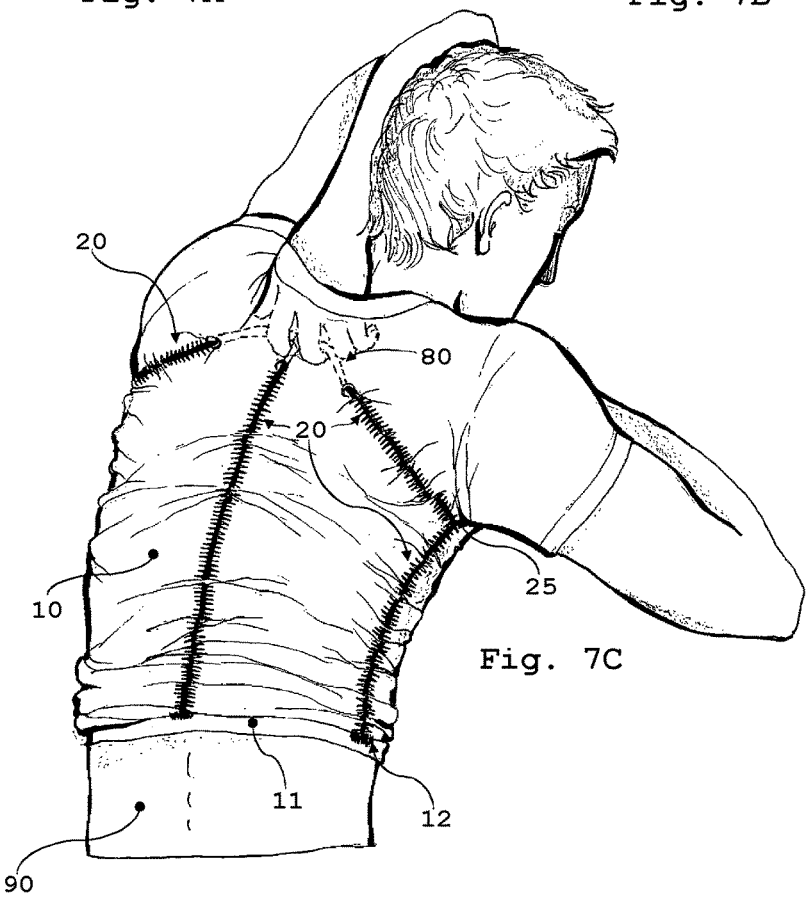

FIGS. 7A-7C show the construction and use of the takeoff means that consists of three guides (20) and three corresponding drawstrings (30) where two of the guides (20) are partially used side seams of the sportswear (10) connecting the front and back part of the said sportswear (10), and one guide (20) is a central guide as in the example 1. So, the mentioned solution represents the fusion of the solutions described in the example 6 and example 1; the way of producing is the same as described in the mentioned examples.

Once the guides (20) are formed around the drawstrings (30) connected to the hemline (11) and handgrip (80), the sportswear (10) is turned onto its ordinary side depicted in FIG. 7A where only the stitches are visible. The activation is similar to those explained in the previous examples and depicted in FIG. 7C.

Other Variants

As already mentioned before, the above simple examples serve merely as an illustration of the invention potential. There is also a possibility to form hybrid versions where the guides are formed on both sides of the sportswear (10), or exclusively on the other side which we did not elaborate in the examples. The person skilled in the art will certainly recognize how to form more sophisticated modifications of the present invention. However, having in mind the aesthetic criteria and other factors related to the manufacture, it is to be expected that the most frequent implementation of the disclosed invention will be the solution where the guides are situated in the inner side of the sportswear (10).

The said invention is possible to be implemented on already formed upper garments that are not worn extremely tight to the wearer's skin, such as ordinary T-shirts. Namely, the present invention can be very easily used in an ordinary upper garment as a takeoff means for helping elderly or disabled people to take off the upper garment.

INDUSTRIAL APPLICABILITY

The present invention is suitable as a simple, reliable and aesthetically acceptable helping means that allows the wet sportswear, in particular the upper sportswear designed to be extremely skintight to the wearer, to be simply taken off over the wearer's head. Therefore, the industrial applicability is obvious.

Considering the fact that elderly people have problems with T-shirts or similar garments tale when taking them off over the head due to their health condition, the possible application of the mentioned takeoff helping means is wider than initially being contemplated.

The embodiments hereby mentioned and represented via figures have to be used only as an example of carrying out the invention as defined by the claims. A skilled person in the art will certainly modify the above embodiments to fit a desired fashion potential.

REFERENCES

10—sportswear
11—hemline
12—joint region
20—guide
21—guide beginning
22—guide end
23—connection
24—interruption
25—kink
30—drawstring
80—handgrip
90—skin
S—segment

The invention claimed is:

1. A shirt comprising:

a front portion and a back portion together configured to extend only over and against an upper body portion of a wearer;

two or more elongated guides fixedly coupled to the back portion, each guide extending from a lower portion of the shirt toward an upper portion of the shirt, an upper portion of the guides adapted at a neck opening of the back portion of the shirt and a lower portion of the guides adjacent a hemline of the shirt;

each guide is provided with a respective drawstring adapted to move linearly with respect to the guide, each drawstring extending past the upper portion of the corresponding guide;

a distal end of each drawstring is fixedly coupled to a lower portion of the back portion on the hemline; and a handgrip fastened to the drawstrings and situated adjacent a back of the neck opening and adapted to be gripped by the wearer reaching behind the wearer's head to grasp the handgrip, where the handgrip transmits a force of the wearer to all drawstrings coupled to the handgrip at a proximal end of the respective drawstrings;

wherein the distal end of the drawstrings retracts the hemline toward the upper portion of the shirt to facilitate removal of the shirt from the wearer.

2. The shirt according to claim 1, wherein the respective lower portion of the guides are spaced apart from one another along the hemline.

3. The shirt according to claim 1, wherein the guides are formed on an inner surface of the shirt.

4. An article of clothing adapted to be worn on an upper body portion of a wearer, the article of clothing comprising:

a front portion and a back portion sized to fit around and against only the upper body portion of the wearer of the article of clothing;

two or more elongated guides fixedly coupled to the back portion, each guide extending from a lower portion of the article of clothing toward a central portion of the article of clothing, a lower portion of the guides adjacent a hemline of the article of clothing;

each of the two or more elongated guides provided with a respective drawstring adapted to move linearly with respect to the guide, a proximal end of each drawstring extending past an upper portion of the corresponding guide, a distal end of each drawstring is fixedly coupled to a lower portion of the back portion of the article of clothing on the hemline;

a further elongated guide fixedly coupled to the back portion, an upper portion of the further guide adapted adjacent a neck opening of the article of clothing and a lower portion of the further guide adjacent respective upper portions of the two or more elongated guides;

the further elongated guide provided with a further drawstring adapted to move linearly with respect to the further guide, the further drawstring extending past both the upper portion and a lower portion of the further guide, a distal end of the further drawstring is fixedly coupled to a proximal end of each respective drawstring; and a handgrip situated adjacent a back of the neck opening and coupled to a proximal end of the further drawstring, the handgrip adapted to be gripped by the wearer when the wearer reaches behind his or her head to grasp the handgrip;

wherein exerting an upward pulling force on the handgrip transmits the force to all drawstrings and retracts the hemline toward the neck opening of the article of clothing to facilitate removal of the article of clothing from the wearer.

5. The article of clothing according to claim 4, wherein the guides are formed on an inner surface of the clothing.

6. The article of clothing according to claim 4, wherein the drawstrings cross one another at a point between the distal end and the proximal end of the respective drawstrings.

7. A shirt comprising:

a front portion and a back portion sized to fit skintight onto only an upper body portion of a wearer;

an elongated guide fixedly coupled to the back portion, the guide extending from a lower portion of the shirt toward an upper portion of the shirt, an upper portion of the guide adapt at a back of a neck opening of the shirt and a lower portion of the guide adjacent a hemline of the shirt;

the guide is provided with a drawstring adapted to move linearly with respect to the guide, the drawstring extending past the upper portion of the guide;

a distal end of the drawstring is fixedly coupled to a lower portion of the back portion of the shirt on the hemline; and a handgrip situated adjacent the back of the neck opening and adapted to be gripped by the wearer reaching behind his or her head to grasp the handgrip, wherein the handgrip transmits a force of the wearer to the drawstring coupled to the handgrip at a proximal end of the drawstring;

wherein pulling the proximal end of the drawstring retracts the hemline of the shirt toward the upper portion of the shirt to facilitate removal of the shirt from the upper body portion of the wearer.

8. The shirt according to claim 7, wherein material for the guide is fixed to the shirt via stitching, ultrasound or laser welding, or by gluing the material to the shirt.

9. The shirt according to claim 7, wherein, material for the guide is a textile material.

10. The shirt according to claim 7, wherein the guide is formed by zigzag stitches through the back portion of the shirt passing over the drawstring.

11. The shirt according to claim 7, wherein the guide is formed on an inner surface of the shirt.

12. An upper body shirt comprising:

a front portion and a back portion configured sized to fit only around an upper body portion of a wearer, the front portion and the back portion coupled to one another along side seams;

sleeves coupled to the front portion and back portion;

elongated guides disposed within the side seams, each guide extending from a lower back portion of the shirt toward a junction formed where the sleeves are coupled to the front portion and back portion, and then extending toward a back of a neck opening of the shirt, a lower portion of the guides adjacent a hemline of the shirt;

each guide is provided with a respective drawstring adapted to move linearly with respect to the guide, each drawstring extending past the upper portion of the corresponding guide;

a distal end of each drawstring is fixedly coupled to the shirt at the hemline; and a handgrip situated adjacent the back of the neck opening attached to a proximal end of each drawstring and adapted to be gripped by the wearer reaching behind the wearer's head and pulling upward on the handgrip, where the handgrip transits a force of the wearer to all drawstrings coupled to the handgrip at a proximal end of the respective drawstrings;

wherein pulling the distal end of the drawstrings via the handgrip retracts the hemline toward the neck opening of the shirt to facilitate removal of the shirt.

13. The shirt according to claim 12, further comprising:

a further elongated guide fixedly coupled to the back portion of the shirt, an upper portion of the further guide adapted to be adjacent the neck opening of the shirt and a lower portion of the further guide adjacent the hemline of the shirt; and the further elongated guide provided with a further drawstring adapted to move linearly with respect to the further guide, the further drawstring extending past both the upper portion and the lower portion of the further guide, a distal end of the further drawstring is fixedly coupled to the shirt at the hemline;

wherein the further drawstring is coupled to the handgrip.

14. A sportswear takeoff helping device for a sportswear garment configured to cover only an upper portion of a wearer, wherein the helping device is formed on a back portion of the sportswear garment, the helping device comprising:

one or more guides, wherein the guides are each equipped with a corresponding drawing member for the guide;

each of the drawing members has a beginning attached to a bottom hemline of the sportswear garment, extending up from the bottom hemline of the hack portion and terminating at a gripping member adjacent a back of a neck opening of the sportswear garment, wherein the gripping member can be grasped by the a wearer of the garment reaching behind his or her head to grasp the gripping member and pulled pulling the gripping member upward thereby causing the hemline and the back portion of the sportswear garment adjacent thereto to be raised toward the wearer's neck thereby facilitating the wearer in removing the sportswear garment over the wearers head.

* * * * *